United States Patent [19]

Coder

[11] 4,274,200

[45] Jun. 23, 1981

[54] LOCK OPEN FOLDING KNIFE WITH SIDE RELEASE

[75] Inventor: James E. Coder, Bradford, Pa.

[73] Assignee: W. R. Case Sons Cutlery Company, Bradford, Pa.

[21] Appl. No.: 100,392

[22] Filed: Dec. 5, 1979

[51] Int. Cl.[3] ..... B26B 1/00

[52] U.S. Cl. ..... 30/161

[58] Field of Search ..... 30/161, 160

[56] References Cited

U.S. PATENT DOCUMENTS

| | | | |
|---|---|---|---|
| 1,357,398 | 11/1920 | Haywood | 30/161 |
| 1,512,689 | 10/1924 | Hermann | 30/161 |
| 1,638,749 | 8/1927 | Santoyo | 30/161 |
| 2,304,601 | 12/1942 | Schrade | 30/160 X |
| 3,868,774 | 3/1975 | Miori | 30/161 |
| 3,942,249 | 3/1976 | Poehlmann | 30/161 |
| 4,040,181 | 8/1977 | Johnson | 30/161 |

*Primary Examiner*—Jimmy C. Peters

*Attorney, Agent, or Firm*—Pennie & Edmonds

[57] ABSTRACT

A folding blade knife in which the blade is held in the open position by a tumbler spring movable in the same plane as the blade and a lock spring movable in a plane perpendicular to the plane of blade movement. The lock spring is mounted in the handle remote from the blade, is movable in a plane by operation of a handle-projecting spring extension and constrained to move in planes perpendicular to said plane by restraining frame piece slots.

2 Claims, 5 Drawing Figures

LOCK OPEN FOLDING KNIFE WITH SIDE RELEASE

BACKGROUND ART

Prior folding knives have employed releasable locking mechanisms including release operable mechanisms projecting from or mounted on a side of the knife handle (see U.S. Pat. No. 272,858 to Korn; U.S. Pat. No. 530,792 to Nordlow; U.S. Pat. No. 812,601 to Schrade; and U.S. Pat. No. 1,521,778 to McLag) but none of these prior arrangements has provided a locking and release mechanism that would hold the blade in a firm open position while also providing a convenient and easy way to operate a handle-projecting control device for facilitating the opening and closing of the knife.

Prior art mechanism have employed spring elements for engaging a notch in the blade tang but the spring elements have not been housed to prevent deflection during use of the blade nor has the handle-projecting device been located and housed to effectively control its release.

SUMMARY OF THE INVENTION

Broadly, the present invention comprises a folding knife releasable blade arrangement in which an elongated deflectable lock spring is mounted in a blade cavity defined by a space between the handle frame pieces and slots formed in the frame pieces. The end of the spring remote from the blade is mounted in a fixed position allowing the remaining portion to be deflected by application of force to a projecting portion of the spring to engage and disengage the blade tang.

It is a feature of the invention that the lock spring is free to move in the plane perpendicular to the plane of rotation of blade while the spring is restrained from deflection or other movement in planes parallel to the plane of blade rotation by slots in the handle frame pieces to prevent the spring from deflecting and releasing the blade under conditions of severe use.

It is also a feature of the invention that the construction is simple, strong and easy to operate.

DESCRIPTION OF THE PREFERRED EMBODIMENT

Figure 1:
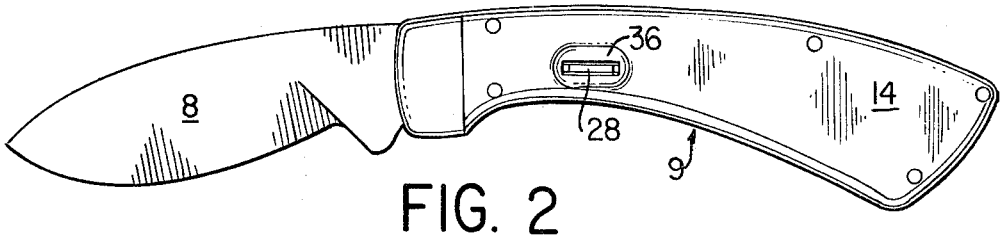
FIG. 1 is a side elevational view of the folding knife of the present invention.

In the drawings, the folding knife includes blade 8 and handle 9 which in turn comprises parallel spaced-apart frame pieces 10 and 11; decorative side grip plates 13 and 14 attached to frame pieces 10 and 11, respectively; central tumbler spring 16 and elongated lock spring 17.

Figure 4:
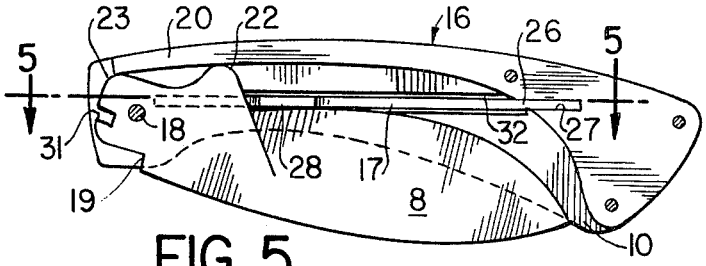
FIG. 4 is a side elevational view, with grips removed, showing the knife in its folded position.

Blade 8, which is pivotable mounted between frame pieces 10 and 11 for rotation about pin 18, has tumbler spring lock notch 19 for receiving tumbler spring arm 20 to limit blade 8 rotation in a clockwise direction beyond the position shown in FIG. 1. Blade 8 also has cam surface tang area 21 including cam protrusions 22 and 23 for positioning blade 8 from arm 20 when the blade is closed (FIG. 4).

Lock spring 17 includes blade-remote end section 26 mounted in tumbler spring slot 27; projection section 28, elbow section 34 and forward blade tang engaging section 29. Lock spring 17 is made of sufficiently flexible material that it may be biased from the position shown in FIG. 3 to the position shown in FIG. 5 to move tang section 29 out of blade tang notch 31 and release the blade for closure.

Figure 5:
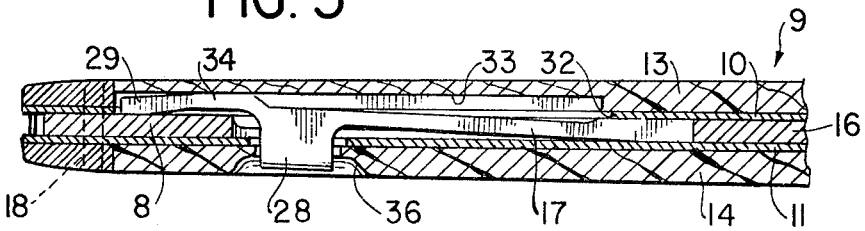
FIG. 5 is a sectional view taken along lines 5—5 of FIG. 4.

Frame piece 10 has slot 32 therein and grip plate 13 has an adjacent recess 33 which slot and recess accommodate lock spring 17 when it is moved to the position shown in FIG. 5. Frame piece 11 has slot 30 and grip plate 14 opening 36 to accommodate projection 28.

Figure 2:
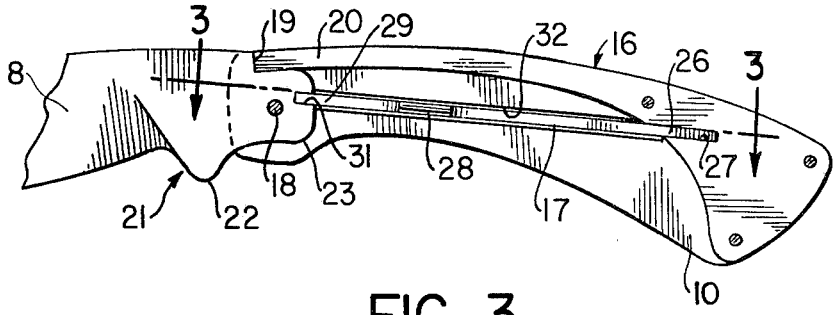
FIG. 2 is a sectional partial side elevational view of the knife.
Figure 3:
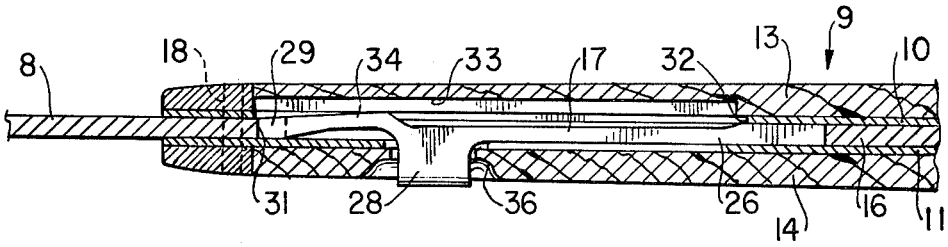
FIG. 3 is a sectional view taken along lines 3—3 of FIG. 2.

In the operation of the folding knife, blade 8 is held in its open position by the engagement of arm 20 in tang notch 19. Blade 8 is further restrained and held in its open position by lock spring 17. The tang engaging section of spring 17 fits into notch 31 of blade 8 and, at the blade-remote end of spring 17 rear section 26 is fixed in tumbler spring slot 27. Movement of blade 8 counterclockwise as viewed in FIG. 2 is restrained by lock spring 17 which spring 17 is confined in the handle cavity against movement downwardly (or upwardly) as shown in FIG. 2 due to the inability of spring elbow 34 to move upon down in slot 35 and the ability of slot 30 to restrict movement of side projection section 28. To close the knife, side projection 28 of spring 17 is pushed upwardly, as shown in FIG. 3, causing spring 17 to move to the position shown in FIG. 5 resulting in tang engaging section 29 moving out of the tang of blade 8 thus freeing the blade to move to the closed position (FIG. 4).

I claim:

1. In a folding knife including a handle, a blade and blade pivot element to permit the blade to be rotated in a plane from a closed to an open position comprising (a) a rotatable blade having a tang with a tang notch therein;

(b) a handle in turn comprising a central tumbler spring member including a base portion including a notch therein remote from the blade and a flexible blade-engageable arm; a first side frame piece on one side of the central member and a second side frame piece on the other side of the central member substantially parallel to and spaced apart from the first frame piece with both pieces being secured to the central member;

(c) a cavity within the handle defined by the spaced-apart frame pieces and the arm of central member, and further defined by the notch in the base of the central member, a first slot in the first frame piece and a second slot in the second frame piece;

(d) a flexible lock spring mounted for operable movement within said handle cavity in a plane perpendicular to the plane of rotation of the blade to lock and unlock the blade, said spring having a blade-remote end fixed in said central member base portion notch, a projection extending into the slot of second frame piece, an elbow portion of the spring accommodated by and positioned in a slot in the first frame piece during movement of the spring, and a blade-adjacent end portion releasably engageable with the blade tang.

2. The folding knife of claim 1 having first and second handle grip plates secured to first and second frame pieces, respectively, with the first grip having a recess positioned opposite and communicating with the first frame piece slot to accommodate the spring in its defected position and the second grip having an aperture through which the spring projection extends.

* * * * *